US010401024B2

(12) United States Patent
Biagioli et al.

(10) Patent No.: US 10,401,024 B2
(45) Date of Patent: Sep. 3, 2019

(54) GAS BURNER FOR COOKING APPLIANCES

(71) Applicant: Defendi Italy S.r.l., Camerano (IT)

(72) Inventors: Cristian Biagioli, Camerano (IT); Luca Breccia, Camerano (IT); Werner Noeth, Camerano (IT); Marco Sbaffi, Camerano (IT)

( * ) Notice: Subject to any disclaimer, the term of this patent is extended or adjusted under 35 U.S.C. 154(b) by 197 days.

(21) Appl. No.: 15/571,839

(22) PCT Filed: Apr. 21, 2016

(86) PCT No.: PCT/IB2016/052277
§ 371 (c)(1),
(2) Date: Nov. 5, 2017

(87) PCT Pub. No.: WO2016/170499
PCT Pub. Date: Oct. 27, 2016

(65) Prior Publication Data

US 2018/0135851 A1 May 17, 2018

(30) Foreign Application Priority Data

Apr. 24, 2015 (IT) ..... VE2015A000018
Sep. 24, 2015 (IT) ..... UB2015A003850

(51) Int. Cl.
*F23D 14/06* (2006.01)
*F23D 14/58* (2006.01)
(Continued)

(52) U.S. Cl.
CPC ..... *F23D 14/06* (2013.01); *F23D 14/04* (2013.01); *F23D 14/065* (2013.01); *F23D 14/58* (2013.01);
(Continued)

(58) Field of Classification Search
CPC ..... F23D 14/04; F23D 14/06; F23D 14/58; F23D 2900/14063
See application file for complete search history.

(56) References Cited

U.S. PATENT DOCUMENTS 4,373,505 A * 2/1983 Koziol ..... A47J 37/0713 126/25 R
4,485,799 A * 12/1984 Perez ..... F23D 14/04 126/25 R
(Continued)

FOREIGN PATENT DOCUMENTS

| | | |
|---|---|---|
| FR | 2505987 | 11/1982 |
| FR | 2692024 | 12/1993 |
| WO | 2012143319 | 10/2012 |

*Primary Examiner* — David J Laux
(74) *Attorney, Agent, or Firm* — Themis Law

(57) ABSTRACT

A gas burner for cooking appliances includes a cup-shaped lower support structure to be applied in a position corresponding with an opening made in the sheet metal of a cooking hob, an injector of substantially horizontal axis, applied to a lateral wall of a first cavity provided in the support structure, a substantially horizontal venturi conduit coaxial with the injector and opening at its downstream end into a second cavity provided in the support structure, open upwards, and communicating fluidly with a distribution chamber for the combustion mixture to generate a flame ring, wherein the venturi conduit includes a tubular element separate from the support structure, housed to undergo free axial movement within a corresponding seat provided in the support structure and lockable in the desired axial position by a locking member accessible from above the support structure through the opening provided in the sheet metal of the cooking hob.

14 Claims, 4 Drawing Sheets

Figure 1:
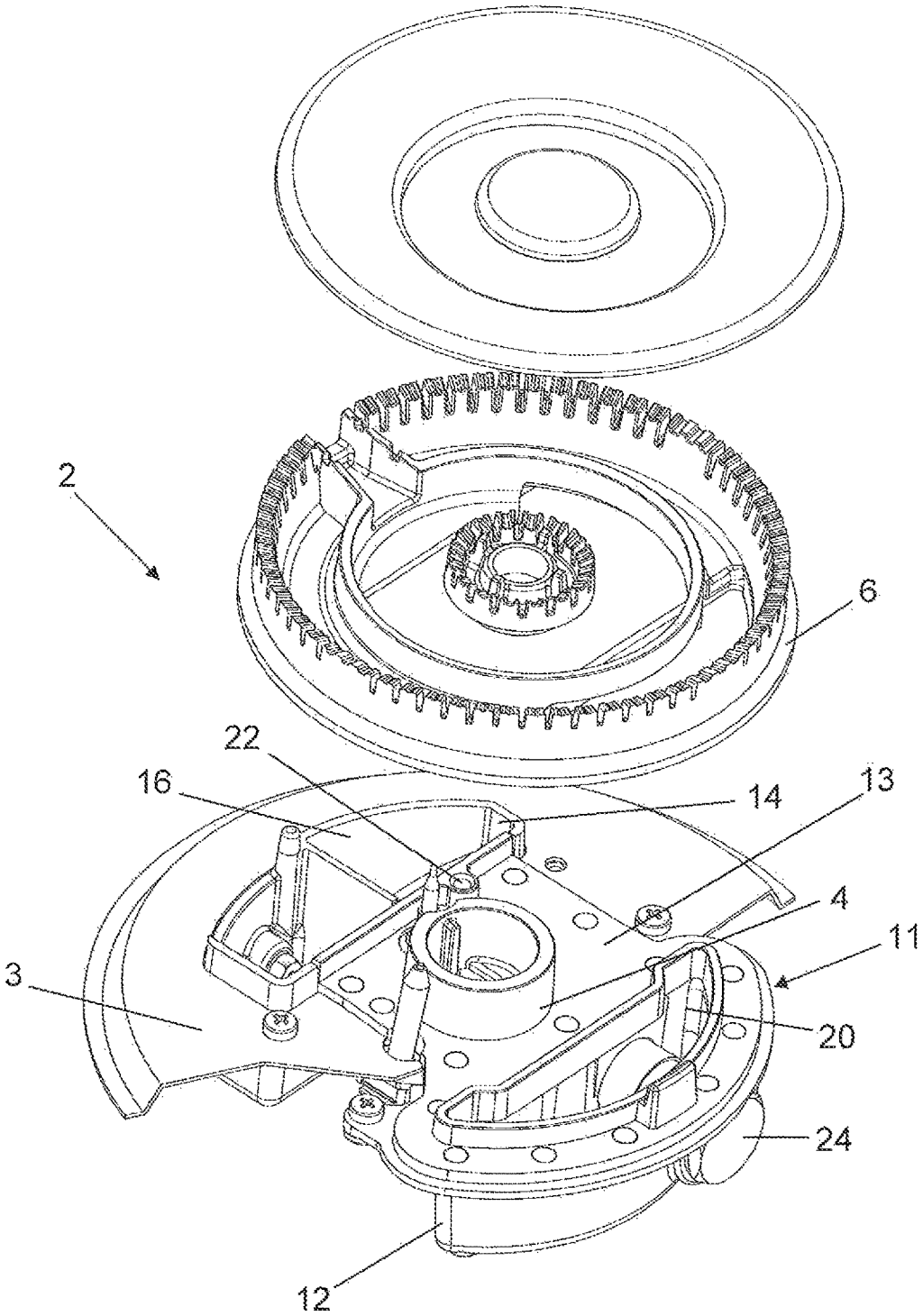

(51) Int. Cl.
*F23D 14/04* (2006.01)
*F24C 3/08* (2006.01)

(52) U.S. Cl.
CPC .... *F24C 3/085* (2013.01); *F23D 2900/14062* (2013.01); *F23D 2900/14063* (2013.01)

(56) References Cited

U.S. PATENT DOCUMENTS

| | | | | |
|---|---|---|---|---|
| 5,704,778 | A | 1/1998 | Hsieh | 3/66 |
| 6,132,205 | A * | 10/2000 | Harneit | F23D 14/06 126/39 E |
| 2001/0010897 | A1 | 8/2001 | Dane | |
| 2013/0014744 | A1* | 1/2013 | Hensley | F24C 3/08 126/39 E |
| 2015/0007900 | A1* | 1/2015 | Li | B01F 5/0428 137/892 |

* cited by examiner

GAS BURNER FOR COOKING APPLIANCES

The present invention relates to an improved gas burner for cooking appliances.

Gas burners are known with one or more rings of main flames, such as that described in US 2001/0010897, to be installed on cooking hobs in general; these generally comprise a cup-shaped injector holder, at which the burner is installed on the cooking hob, a burner body, on which one or more venturi conduits are provided for mixing the gas with primary air to form the combustion mixture, a flame divider with one or more chambers for distributing the combustion mixture to generate the flame rings, and with upper closure covers for the distribution chambers.

The market offers a vast range of burners with one or more main flame rings, with each user making individual choices based on certain burner aspects rather than others, according to requirements.

Gas burner manufacturers are often faced with a problem in that in the various countries or even in different regions of the same country, large differences can exist in the chemical gas composition, requiring burners with different characteristics.

As it has been found by research and experimentation that correct burner operation with a determined type of gas is linked to the correct distance between the venturi conduit and the injector, and that as the gas composition varies this distance must be varied to obtain optimal burner operation, burners have also been proposed in which the axial position of the venturi conduit relative to the injector can be adjusted. These burners have however proved extremely complex and bulky and require the upper sheet metal of the cooking hob to be removed for their adjustment.

FR 2692014 describes a pipe burner, in which the injector is located a large distance from the burner head; this is not suitable for installation on a cooking hob and moreover is rather complicated to assemble and hence costly, given that it comprises a large number of components, and in particular comprises a flame divider head, a curved first conduit, a second conduit internally housing a venturi conduit, two flanges and a U-shaped flange for supporting the injector.

Consequently, an object of the invention is to provide a gas burner which can be installed in a cooking hob, and in which the position of the venturi conduit or of each venturi conduit can be adjusted relative to the injector, without having to disassemble the cooking hob.

Another object of the invention is to be able to make this adjustment easily and quickly.

Another object of the invention is to produce a burner in a very simple form and at low cost.

All these objects and others which will be apparent from the ensuing description are attained according to the invention by an improved gas burner for cooking appliances as described in claim 1.

Figure 2:
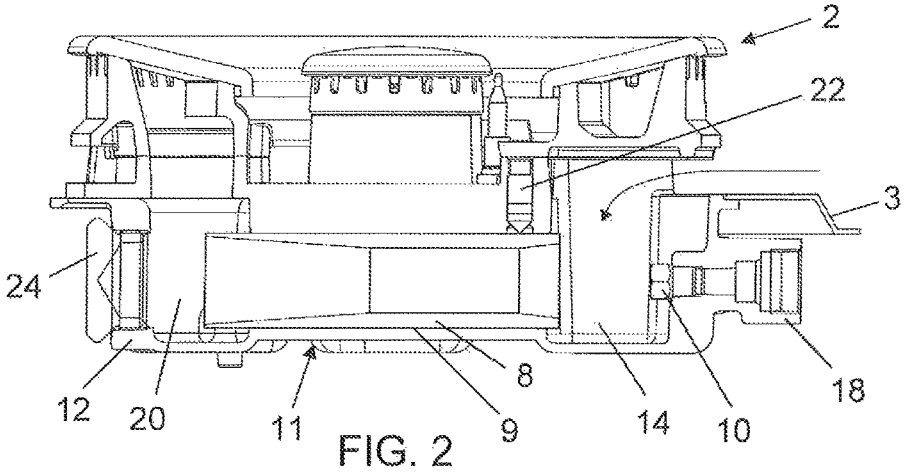
Figure 3:
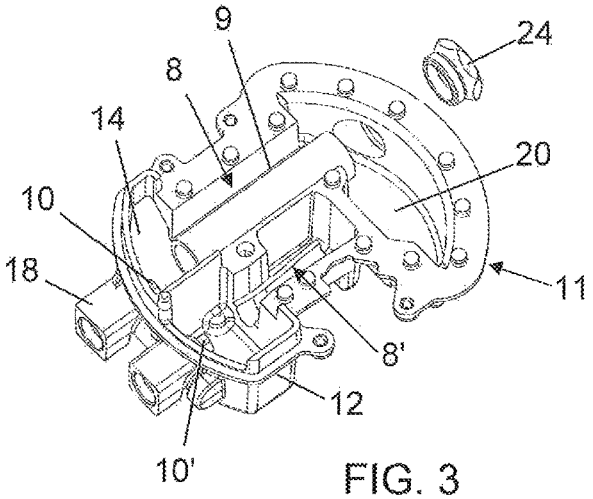
Figure 4:
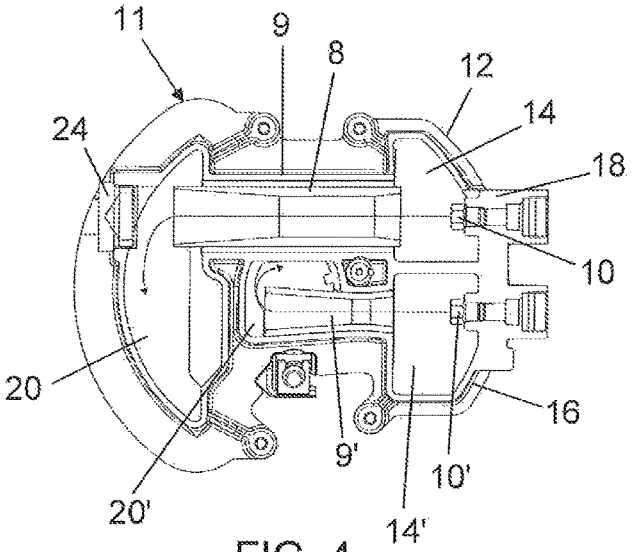
Figure 5:
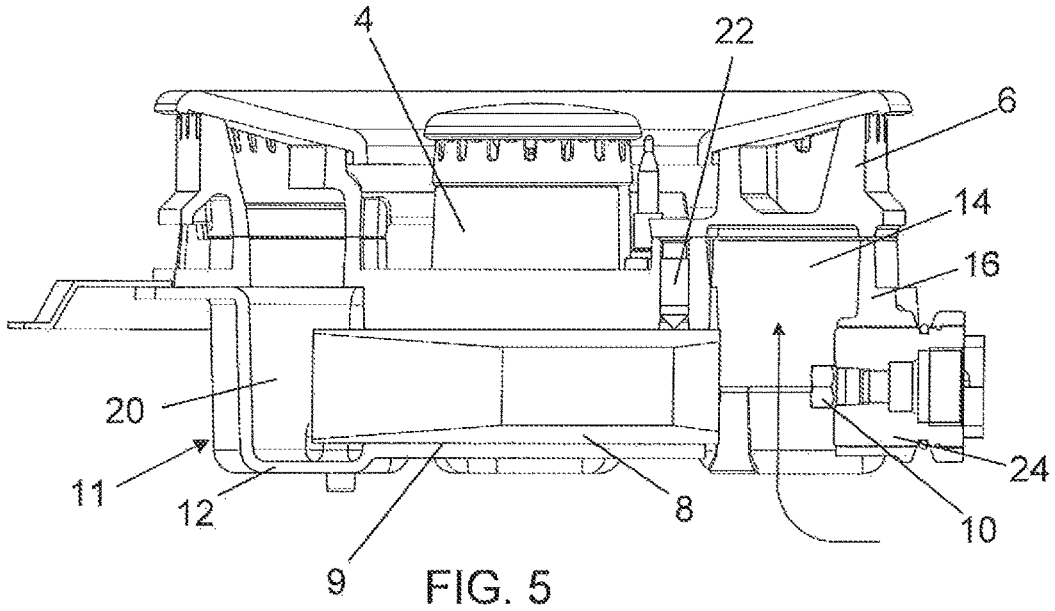
Figure 6:
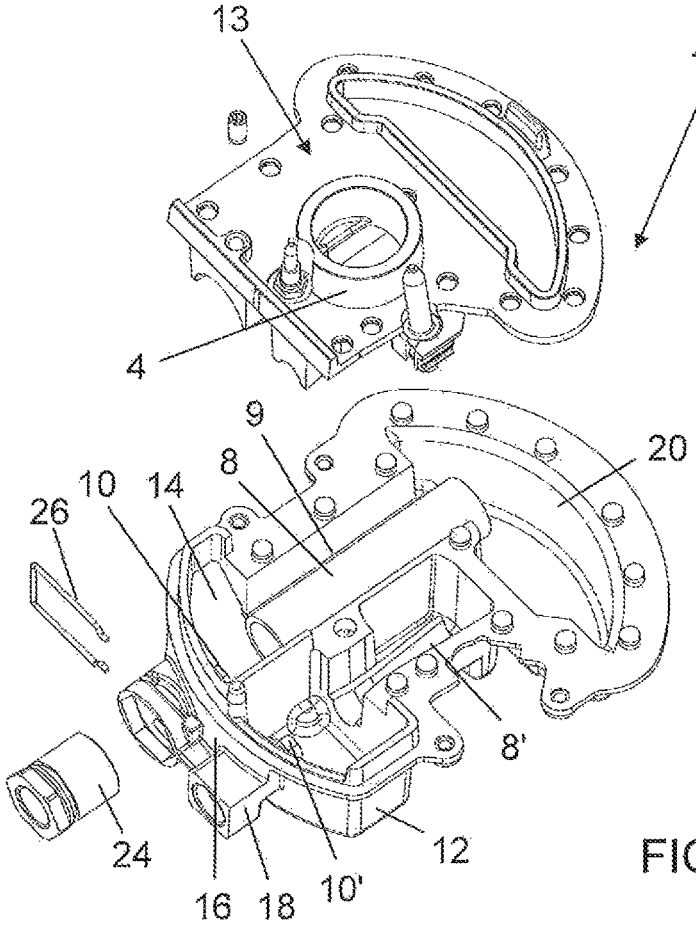
Figure 7:
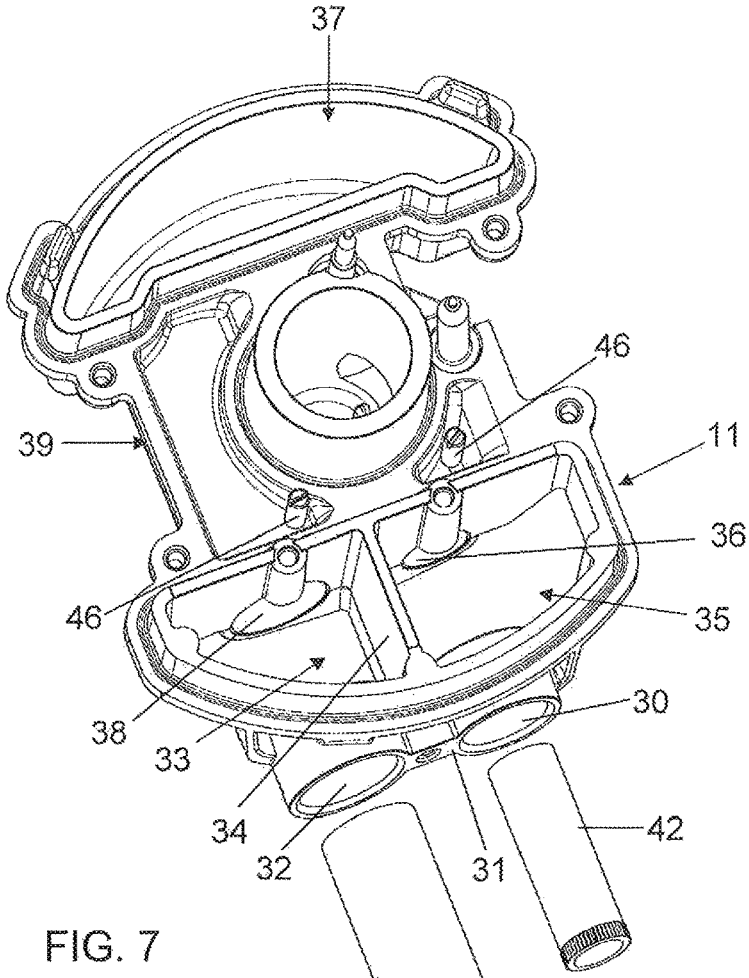
Figure 8:
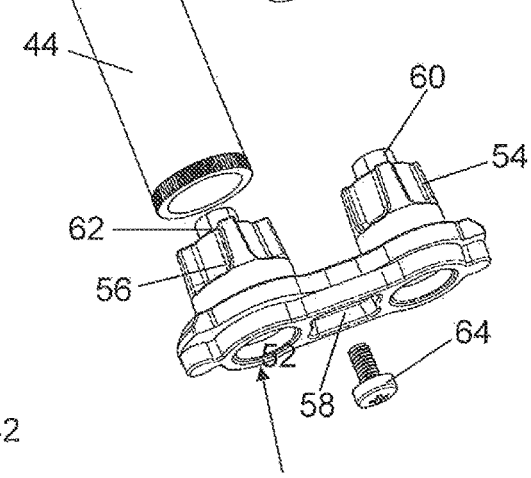
Figure 8:
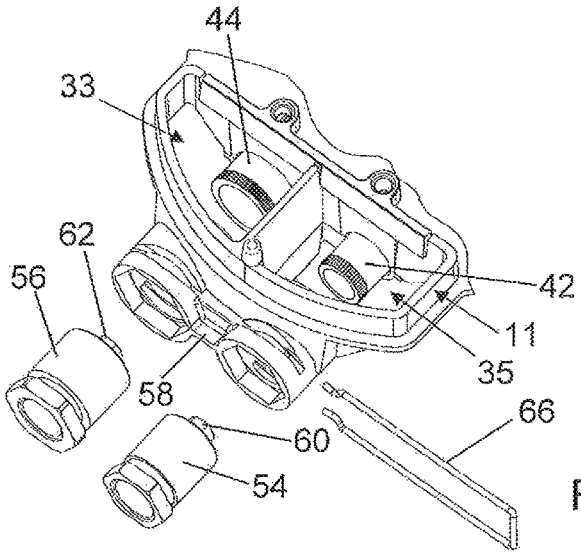

The present invention is further clarified hereinafter in terms of some preferred embodiments thereof, with reference to the accompanying drawings, in which:

FIG. 1 is an exploded perspective view showing a first embodiment of a burner according to the invention, FIG. 2 is a vertical diametrical section therethrough, FIG. 3 is a perspective view showing the cup-shaped support for the injector holder structure, FIG. 4 is a plan view thereof, FIG. 5 is a vertical section through a second embodiment of the burner according to the invention, and FIG. 6 is an exploded perspective view of its injector holder structure, FIG. 7 is an exploded perspective view of a third embodiment of the lower support structure of the burner of FIG. 1, and FIG. 8 is an exploded perspective view showing a fourth embodiment of part of the structure of FIG. 7.

As can be seen from FIGS. 1-6, these show a particular multi-ring burner 2 to be applied to the upper sheet metal 3 of a traditional cooking hob, preferably of built-in type, in a position corresponding to an aperture provided therein.

The burner 2 has an inner circular distribution chamber 4 and an outer annular distribution chamber 6, to which mixtures of gas and primary air arrive originating from two separate venturi conduits 8, 8' fed with gas delivered by respective injectors 10, 10'. However, it is to be understood that the burner type, the number of flame rings, the number of injectors, and an entire series of characteristics recognizable in the burner illustrated in the drawings by way of example, could also be different, in the sense that, that which characterises the burner according to the invention is the manner of adjusting at least one venturi conduit 8, 8' relative to the injector 10, 10' which lies to the front thereof.

The venturi conduit 8 is housed within a lower support structure 11 of the burner 2, and preferably within its lower cup 12.

In particular, the venturi conduit 8 is disposed approximately horizontal within the lower cup 12 and opens at its upstream end into a cavity 14, which is defined in said cup 12, is open lowerly, is closed upperly, and presents in a curved lateral wall thereof 16 an outer connector 18 for the gas and inner threaded seat for the injector 10.

In particular, the venturi conduit 8 is faced at its upstream end by the injector 10, it extends horizontally within the lower cup 12 of the support structure 11 and opens at its downstream end into an arched cavity 20, also provided in the lower cup 12, which is open upperly and is intended to feed at least one curved distribution chamber provided in at least one flame divider overlying said cup 12.

Preferably, the venturi conduit 8 is obtained from a piece of metal or non-metal tube which is externally cylindrical and internally shaped such as to define a first downwardly converging portion close to the injector 10, a second portion of constant cross-section, and a third downwardly diverging portion.

The venturi conduit 8 is inserted into and housed in a seat 9 provided in the lower cup 12. Correspondingly, the seat 9 also extends horizontally within the lower cup 12 to connect together the cavity 14 and the arched cavity 20.

Advantageously, the seat 9 is a cylindrical through seat and, preferably, the venturi conduit 8 has a length greater than the length of said seat 9, such as to project therefrom with both its ends into the two cavities 14 and 20.

As represented for example in FIG. 6, the lower support structure 11 can be formed from two parts, i.e. from the lower cup 12 and from a cover element 13, which can be joined together either permanently by rivets or removably by screws. In this embodiment, the seat 9 can be defined lowerly by an elongated cavity provided in the lower cup 12, and upperly by a complementary cavity provided in the cover element 13.

The venturi conduit 8 has an outer diameter slightly less than the inner diameter of its seat 9, such as to be able to be easily displaced axially within it.

The seat 9 housing the venturi conduit 8 communicates with the space overlying the lower support structure 11 of the burner via an internally threaded cylindrical hole housing a grub screw 22 for locking the venturi conduit 8 in its seat 9.

The head of this grub screw 22 is preferably provided with a hexagonal recess into which a traditional Allen key can be inserted for its operation from above through the aperture provided in the sheet metal 3, without having to remove the burner 2 from the cooking hob to which it is applied.

In the embodiment shown in FIGS. 1-4, the arched cavity 20 into which the downstream end of the venturi conduit 8 opens, presents, in a position facing said venturi conduit 8, an aperture which can be closed by a plug 24 applicable from the outside. Its purpose is to enable the venturi conduit 8 to be inserted into its seat through said aperture during burner assembly, and also to enable its possible substitution, should it be necessary to modify its characteristics and performance.

In the embodiment shown in FIGS. 5 and 6, the plug 24 is applied to the lateral wall 16 of the cavity 14, and is provided with a threaded axial cavity for the injector 10 and with an external connector for the gas. Advantageously, the plug 24 is retained in its seat by an elastic fork 26.

Whereas the installation of the burner 2 on the cooking hob and its operation are traditional and do not form a subject matter of the invention, and for this reason can be varied in accordance with the burner characteristics, that which does in contrast constitute a characteristic of the invention is the adjustability of the axial position of the venturi conduit 8 relative to the injector 10.

If it does becomes necessary to vary this position to adapt the burner to the characteristics of the available gas, and which can be done during installation or during use, the operation is extremely simple and can be carried out even with the burner installed on the cooking hob, and at the very most after removing that burner part defining the outer annular distribution chamber 6, and which rests on the lower support structure 11.

Following this removal, the hexagonal cavity provided in the head of the locking grub screw 22 becomes accessible, so that it can be unscrewed, for example by a suitable Allen key.

After the grub screw 22 has been slackened, by which the venturi conduit 8 is able to be moved within its seat, it can be displaced along it such that its upstream end can be positioned at the correct distance from the injector 10. This operation can be facilitated not only by the mobility of the venturi conduit 8 within its seat, but also by the presence of both ends projecting into the respective cavities 14 and 20, and easily accessible from above through the opening made in the upper sheet metal of the cooking hob.

When the correct axial position of the venturi conduit 8 has been achieved in its seat, it can be securely locked therein by completely screwing down the grub screw 22.

It should also be noted that in the lower cup 12 of the lower support structure 11, several seats 9 can be provided, each of which is intended to house a venturi conduit 8, 8', as described above. In this case, the described adjustment operation can be repeated independently for each venturi conduit.

In particular, the burner according to the invention could have two venturis 8, 8' adjustable within their respective seats 9. In greater detail, a first seat 9 connects, as stated, an inlet cavity 14 of the lower support 11 to an outlet cavity 20 which is in fluidic communication with the outer annular distribution chamber 6; whereas the other seat 9' connects an inlet cavity 14' of the lower support 11 to an outlet cavity 20' which is in fluidic communication with the inner central distribution chamber 4 (see FIG. 4).

In the embodiment illustrated in FIG. 7, the lower support structure 11 consists of a single piece, and presents a shape which is irregular but preferably with it outer edge inscribable within a circumference.

In particular, the lower support structure 11 is of cup shape and comprises:

- a first portion provided with a first cavity which is divided by a vertical baffle 34 into two chambers 33, 35 which are provided on their outer wall 31 with two circular apertures 30, 32,
- a second portion provided with a second cavity 37 situated in a position diametrically opposite the first cavity,
- a third connection portion indicated overall by 39, which connects the two preceding portions together.

Moreover, two parallel cylindrical conduits 36, 38 are provided within the lower support structure 11, and are axially aligned with the two apertures 30, 32. Advantageously, these two conduits 36, 38 can be easily formed by suitably boring through the lower support structure 11 from one side to the other.

An externally cylindrical respective tubular element 42, 44 internally shaped as a venturi (venturi conduit) is insertable into each of the two cylindrical conduits 36, 38, and has a convergent upstream portion followed by a cylindrical central portion, then by a divergent downstream portion.

The outer diameter of each venturi conduit 42, 44 is suitably slightly less both than the inner diameter of the respective apertures 30, 32, and than the inner diameter than the corresponding cylindrical conduits 36, 38, both to enable each venturi conduit 42, 44 to be inserted into the respective cylindrical conduit through the respective aperture 30, 32, and to enable it to move axially therein.

Each venturi conduit 42, 44 can be locked within the respective cylindrical conduit 36, 38 in the desired axial position, by means of a grub screw 46 provided through the inner lateral wall of each of the two chambers 33, 35 and operable from above the cooking hob on which the burner is installed.

Advantageously, the length of each venturi conduit 42, 44 is greater than the length of the respective cylindrical conduit 36, 38 in which it is housed, so that it is able to project from both its ends.

An injector holder unit 52 can be inserted through the two circular apertures 30, 32 provided in the outer wall 31 to the cavity provided in the support structure 11. This unit consists of two roughly cylindrical parts 54, 56 joined together by a connecting cross-piece 58. The injector holder unit can also be formed as two separate cylindrical parts 54, 56 insertable into the two apertures 30, 32 of the support structure 11 and fixable to them by conventional systems.

Independently of the embodiment used, in each of these parts 54, 56 a threaded outer cylindrical cavity is provided for connecting a gas feed conduit, together with a threaded inner cylindrical cavity for connecting an injector 60, 62, which is coaxial with the venturi conduit 42, 44 housed in the respective cylindrical conduit 36, 38 when the injector holder unit 52 is fixed to the support structure 11.

The injector holder unit 52 is removably connected to the cup shaped structure 11 by a screw 64, which passes through the connection bar 58 and engages in the outer wall 31 of the cup structure 11, after the two cylindrical parts 54, 56 of the injector holder unit 52 have been inserted into the respective apertures 30, 32. To avoid assembly errors, both the two cylindrical pieces 54, 56, and the respective apertures 30, 32 have different diameters.

In contrast, in the case of an injector holder unit formed as two separate cylindrical parts 54, 56, one for each injector, these can be both fixed to the support structure 11, for example by a traditional spring clip 66, as visible in FIG. 8.

In assembling the burner according to the invention, the two venturi conduits 42, 44 are firstly inserted into the corresponding cylindrical conduits 36, 38 of the support structure 11, after which the injector holder unit 52 is applied to the burner body and is fixed to it by the screw 64.

The burner assembled in this manner is ready to be installed in the cooking hob. For this purpose the gas feed conduits are fixed to the injector holder unit 52, and the support structure 11 is fixed by screws to the sheet metal of the cooking hob.

The operation of the burner 2 with the support structure 11 of FIG. 7 is substantially traditional and will therefore not be further described.

Depending on the characteristics of the available gas, it may be necessary to vary the distance between the inlet aperture of the venturi conduit 42, 44 and the respective injector 60, 62, which operation can be easily carried out by simply slackening the locking grub screw 46 of one or other venturi conduit 42, 44 or of both, to enable said venturi conduit 42, 44 to be axially adjusted before being re-locked in the correct position.

In a different embodiment, the injector holder unit 58 is formed as a single piece with the support structure 11. In this case it is evidently not possible to insert the venturi conduits 42, 44 through the application apertures of the injector holder unit 58, and apertures have to be provided in the outer wall of the second cavity 37, which apertures, after insertion of the venturi conduits 42, 44, are closed by suitable threaded plugs, as already described with reference to FIG. 1. From the aforesaid it is apparent that the burner according to the invention is particularly advantageous compared with traditional burners, in that:

- it is of compact construction and therefore also suitable for installation in built-in cooking hobs of small thickness,
- it is of simple, lightweight and low-cost production, by consisting of only a small number of components,
- the position of the venturi conduit/conduits can be easily and quickly adjusted, even with the burner installed on the cooking hob, and hence the burner can be adapted to different feed gas characteristics,
- it enables the upstream end of the venturi conduit to be positioned very close to the corresponding injector, if this is required for correct burner operation, while still enabling it to be withdrawn therefrom, for easy burner replacement when necessary.

The invention claimed is:

1. An improved gas burner for cooking appliances, comprising:

a cup-shaped lower support structure (11, 12, 13), adapted to be applied in a position corresponding with an opening made in the sheet metal (3) of a cooking hob;

at least two injectors (10, 10', 60, 62), of substantially horizontal axis, applied to a lateral wall (16, 31) of a first cavity (14, 33, 35) provided in said support structure (11, 12, 13); and at least two substantially horizontal venturi conduits (8, 8', 42, 44), each of them is coaxial with a corresponding injector (10, 10', 60, 62) and having a downstream end opening into a corresponding second cavity (20, 20', 37), which is provided in said support structure (11, 12, 13), is open upwards, and communicates fluidly with at least one distribution chamber (4, 6) for a combustion mixture, to generate at least one flame ring, wherein each of said at least two venturi conduits (8, 8', 42, 44) comprises a tubular element, which is separate from said support structure (11, 12, 13), is housed to undergo free axial movement within a corresponding seat (9, 36, 38) provided in said support structure (11, 12, 13), and is lockable in a desired axial position by at least one locking member (28, 46) accessible from above said support structure (11, 12, 13) through said opening provided in the sheet metal (3) of the cooking hob, said at least two venturi conduits (8, 8', 42, 44) being adjustable independently within their respective seats (9, 36, 38).

2. The burner as claimed in claim 1, wherein said seat (9, 36, 38) for housing said venturi conduit (8, 8', 42, 44) is cylindrical.

3. The burner as claimed in claim 1, wherein the seat (9, 36, 38) for housing said venturi conduit (8, 8', 42, 44) is provided in an interior of the support structure (11, 12, 13) between said first cavity (14, 33, 35) and said second cavity (20, 37), the venturi conduit (8, 8', 42, 44) bringing said first cavity (14, 33, 35) and said second cavity (20, 20' 37) into fluid communication.

4. The burner as claimed in claim 1, wherein said cup-shaped support structure (11, 12, 13) is substantially inscribable within a circumference.

5. The burner as claimed in claim 1, wherein said venturi conduit (8, 8', 42, 44) and corresponding housing seat (9, 36, 38) extend horizontally within an overall dimension of the support structure (11, 12, 13).

6. The burner as claimed in claim 1, wherein said support structure (11) comprises an injector holder cup (12) and a cover element (4) which are connected together, said seat (9) for housing said venturi conduit being defined by an elongated cavity which is provided in said injector holder cup (12) and which is closed upperly by a lower surface of said cover element (13).

7. The burner as claimed in claim 1, wherein said support structure (11) is made in a single piece, said seat (9, 36, 38) for housing said venturi conduit being defined by a through cylindrical cavity.

8. The burner as claimed in claim 1, wherein an axial length of said venturi conduit (8, 8', 42, 44) is greater than a minimum distance between said first cavity (14, 33, 35) and said second cavity (20, 37) provided in said support structure (11, 12, 13).

9. The burner as claimed in claim 1, wherein said locking member (28, 46) comprises a grub screw (22) engaged in a threaded seat provided in said support structure (11, 12, 13) and having a tip engaging an outer lateral surface of said venturi conduit (8, 8', 42, 44).

10. The burner as claimed in claim 1, further comprising a removable plug (24) applied to a wall of said support structure (11, 12, 13) in a position corresponding to an aperture (30, 32) facing an end of said venturi conduit (8, 8', 42, 44) and having dimensions such as to enable said venturi conduit to be withdrawn through said aperture.

11. The burner as claimed in claim 10, wherein said removable plug (24) is provided with a threaded seat for engaging said corresponding injector (10, 10') and with a connector for a gas.

12. The burner as claimed in claim 1, wherein at least one circular aperture (30, 32) is provided in an outer wall (31) of said first cavity (33, 35) for the insertion of said corresponding venturi conduit (8, 8', 42, 44) into a corresponding seat (9, 36, 38) for housing said venturing conduit provided in said support structure (11).

13. The burner as claimed in claim 1, further comprising an injector holder unit (52) removably inserted into said at least one aperture (30, 32) provided in the support structure (11).

14. The burner as claimed in claim 13, wherein said injector holder unit (52) comprises at least one cylindrical part (54, 56) insertable into a corresponding aperture (30, 32) provided in said support structure (11), said cylindrical part (54, 56) comprising a gas connector and a member fixing at least one injector (60, 62), said member being configured such that, when said injector holder unit (52) is fixed to the support structure (11), said at least one injector (60, 62) is coaxial with the corresponding venturi conduit (42, 44) housed in the respective seat (36, 38) housing said venturi conduit.

* * * * *